United States Patent [19]

Ward

[11] 4,145,024

[45] Mar. 20, 1979

[54] FORM FOR REINFORCED CONCRETE WALL

[76] Inventor: Edward B. Ward, 820 Winchester, Kansas City, Mo. 64125

[21] Appl. No.: 846,154

[22] Filed: Oct. 27, 1977

[51] Int. Cl.[2] ..... E04G 11/12; E04G 17/08

[52] U.S. Cl. ..... 249/35; 249/41; 249/91; 249/218

[58] Field of Search ..... 249/35, 40, 41, 44, 249/45, 91, 190, 191, 213, 214, 216–218

[56] References Cited

U.S. PATENT DOCUMENTS

| | | | |
|---|---|---|---|
| 1,526,776 | 2/1925 | Dalidz | 249/40 |
| 3,077,653 | 2/1963 | Ward | 249/196 |
| 3,197,171 | 7/1965 | Michalak | 249/91 |
| 3,199,827 | 8/1965 | Terry | 249/41 |
| 3,263,956 | 8/1966 | Hawkins | 249/40 |
| 3,664,630 | 5/1972 | Maynen et al. | 249/112 |
| 3,899,155 | 8/1975 | Ward | 249/189 |
| 3,995,825 | 12/1976 | Ward et al. | 249/41 |

*Primary Examiner*—Roy Lake
*Assistant Examiner*—John McQuade
*Attorney, Agent, or Firm*—Fishburn, Gold & Litman

[57] ABSTRACT

A form for poured concrete walls includes a plurality of prefabricated, interconnected form panels which are positioned end to end, in two, spaced apart rows to form a wall cavity therebetween. Each pair of associated, opposed form panels has at least two tie bars extending laterally between the panels in a mutually spaced apart and aligned relationship. A pair of mutually parallel and spaced elongate rods are positioned perpendicularly to each of the tie bars and are fixedly attached thereto, and rigidly align and hold the form panels in a set plumb and straight position. One of the rods is shaped for connecting reinforcing mesh thereto, and accurately and positively positions the mesh along a central, predetermined plane between the form panels for improved wall strength, reduced material usage and labor efficiency.

4 Claims, 4 Drawing Figures

FORM FOR REINFORCED CONCRETE WALL

BACKGROUND OF THE INVENTION

The present invention relates to a form tie for making poured concrete walls, and may be used with conventional wood forms, and is particularly adapted for use in conjunction with prefabricated, interconnected poured concrete wall forms, such as those disclosed in my U.S. Pat. No. 3,899,155. In the construction of poured concrete walls, the prefabricated form panels are carefully aligned and interconnected so as to form a straight and plumb wall cavity. Wire reinforcing mesh is generally placed along the longitudinal center of the wall cavity to support and strengthen the wall. If the form is inadvertently jarred, or if excessive forces are placed thereon such as by scaffolding or the like, the form may be moved from its preset position to a laterally inclined position wherein it assumes the shape of a parallelogram, thereby resulting in a poorly constructed building wall.

Further, to achieve the greatest structural strength, the wire mesh is typically disposed along the longitudinal center of the wall in a substantially flat plane which is parallel with the interior surface of both rows of wall forms. If the position of the wire mesh with respect to the form panels is somewhat off-center, or if the wire mesh is not substantially flat, the strength of the wall being poured therein is reduced considerably. Should the form panels move from their aligned, preset position, the wire mesh is also generally displaced. Inasmuch as the wire mesh is positioned in the form during an on-the-sight installation, improper and/or imprecise placement of the wire mesh is very common. Hence, architects and other designers of poured walls must generally account for such inaccuracies, and must apply a substantial safety factor in their wall thickness design calculations to accommodate for this occurrence, thereby resulting in thicker walls and greater material usage.

The principal objects of the present invention are: to provide a tie for rigidly interconnecting opposing panels for poured concrete wall forms; to provide such a tie having means for positively and securely positioning reinforcing mesh between opposing rows of concrete form panels; to provide such a tie having a pair of vertically disposed, interconnected tie rods for accurate wire mesh placement and secure from panel interconnection without external form supports; to provide such a tie wherein upper ends of the vertical rods are interconnected for greater strength and rigidity; to provide such a tie wherein said vertical rod upper ends form a U-shaped bracket which is adapted to accurately receive and retain a horizontally disposed reinforcing member therein; to provide such a tie for quick and easy assembly of said form; to provide such a tie wherein wire ties interconnect the tie and the wire mesh for reduced form assembly time and cost; to provide such a tie for use in combination with a form liner positioned between the form panels, and shaped to form a contiguous post and beam construction; and to provide such a tie which is economical to manufacture, efficient in use, and particularly well adapted for the proposed use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 3:
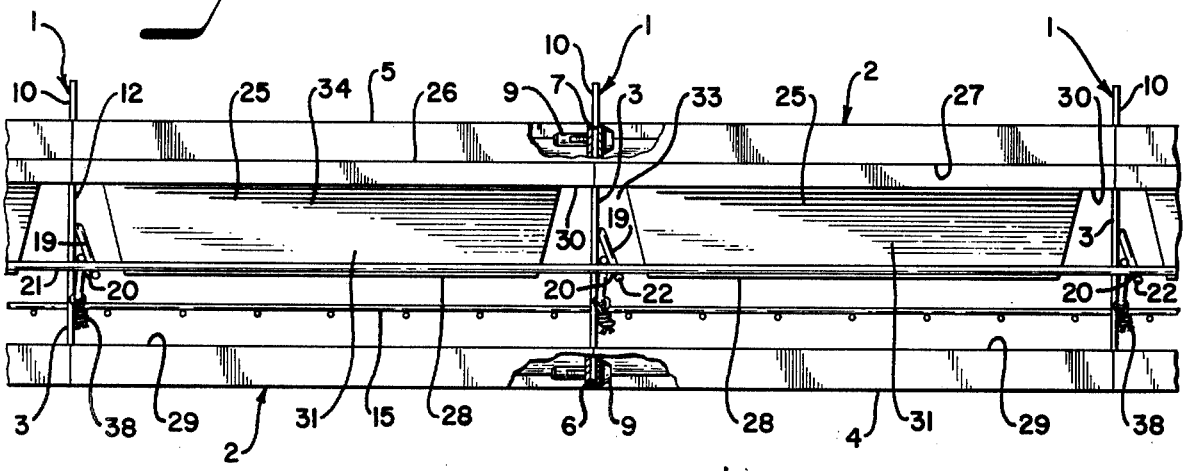
FIG. 3 is an enlarged fragmentary top elevational view of a plurality of interconnected wall forms and ties therefor.

The reference numeral 1 generally designates a tie for poured concrete wall forms 2 embodying the present invention and comprises at least two tie bars 3 extending laterally between opposingly positioned form panels 4 and 5 in a mutually spaced apart and aligned relationship. Each of the tie bars 3 has opposing end portions 6 and 7, and includes connecting means positioned at each end for attachment with the associated form panels 4 and 5 respectively. In this example, four tie bars 3 are provided, and each is mutually spaced apart a distance in the nature of 25 and 5/16th inches. A laterally disposed aperture 8 is disposed through each of the tie bar ends 6 and 7, and is adapted for matingly receiving a retaining pin 9 (FIG. 3). The illustrated tie bars 3 are slightly elongated and include an end member 10 having an aperture 10' therethrough to accommodate use with walls of various thicknesses, to align the various form panels, and/or support other fixtures, such as lifting devices, braces, scaffolding, or the like. Lines of weakness 11 are formed between the side edges 12 of the tie bar adjacent both end portions 6 and 7 thereof and provide means for severing or removing the protruding portion of the tie bar from the wall after the poured concrete has solidified. Each of the illustrated tie bars 3 has a substantially uniform, rectangular transverse cross-sectional shape, and is preferably constructed of a suitable carbon steel.

An elongate rod 14 is positioned substantially perpendicularly to each of the tie bars 3 and is fixedly attached thereto for securely retaining the tie bars in alignment. The rod 14 is shaped for connecting reinforcing mesh 15 thereto and for positively positioning the mesh 15 along a predetermined plane between the opposed form panels 4 and 5. The tie 1 preferably includes a second elongate rod 16, shaped similarly to rod 14 and positioned substantially parallel and spaced apart with rod 14 and being fixedly connected with each of the tie bars 3. Each of the rods 14 and 16 is securely attached to each tie bar 3 by suitable means such as screws, bolts, rivets, bonding, or the illustrated welds 17.

Figure 1:
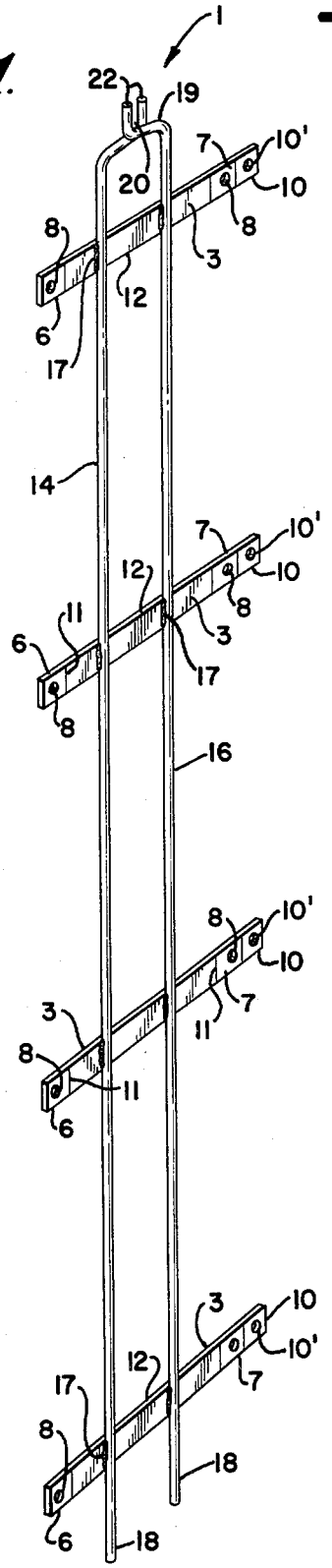
FIG. 1 is a perspective view of a tie for poured concrete wall forms embodying the present invention.
Figure 2:
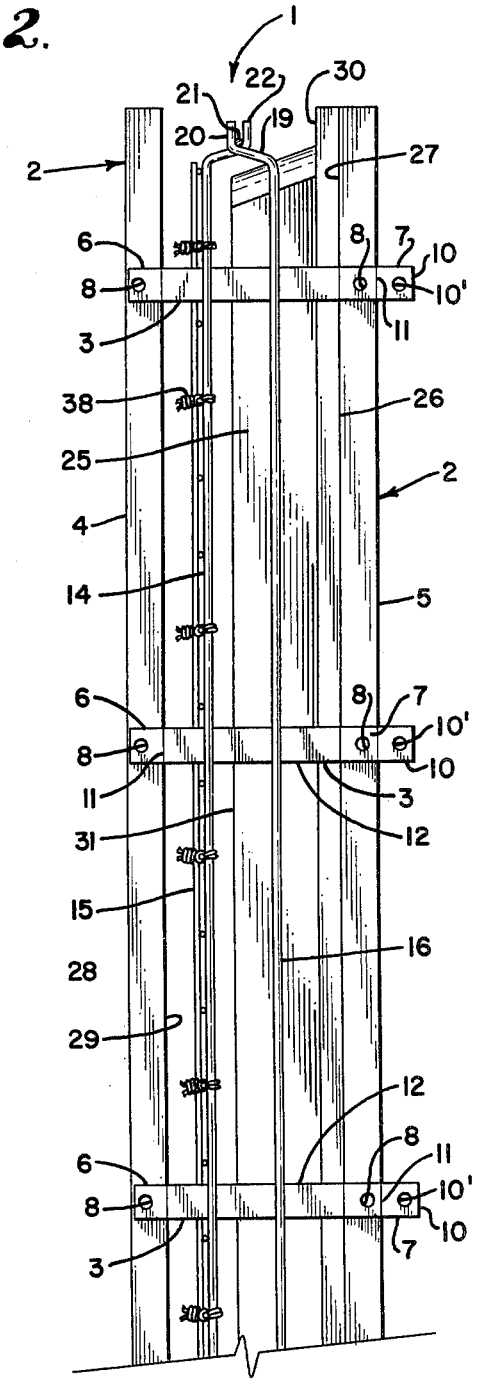
FIG. 2 is an enlarged fragmentary side elevational view of the tie, shown connected with a form for poured concrete walls.

In the orientation illustrated in FIGS. 1 and 2, the lowermost tie bar is positioned a distance in the nature of 8 and 1/32 inches from the lower terminal end 18 of the rods 14 and 16. The rods 14 and 16 include a generally, downwardly disposed, straight, lower end 18, and an L-shaped upper end 19. In the illustrated structure, the upper ends 19 are interconnected by means such as welding, and overlap in a side-by-side fashion to form a U-shaped bracket 20 which is adapted to receive and retain a horizontally disposed reinforcing member 21 therein. The terminal end portion 22 of each upper rod end 19 extends upwardly from the bottom of the U-shaped bracket 20, and is mutually spaced apart a predetermined distance to support or cradle the reinforcing member 21 therein. The diameter of the illustrated rods 14 and 16 is in the nature of ½ inch, and has, along with the size of the mesh 15, been enlarged in FIGS. 1–3 with respect to the other member of the form for illustration purposes only. Hence, the angled relationship between the upper ends 19 of the rods 14 and 16 as shown in FIG. 3, is greatly exaggerated.

The horizontal reinforcing member 21 may be of any suitable shape, such as rectangular bar, channel, Tee-shaped support, or the illustrated cylindrical rod. The bracket 20 is formed to mate with the shape of the selected reinforcing member and in this example, positions the reinforcing member 21 substantially half way between the inside surfaces of the form panels 4 and 5. The rods 14 and 16 are preferably constructed of a fairly rigid, carbon steel which is compatible with and will readily and securely fuse or weld to each of the tie bars 3.

The tie 1 is particularly adapted for use in conjunction with interconnected poured concrete form panels and liners therefor such as those described in my copending United States patent application Ser. No. 789,451, filed Apr. 20, 1977. In the illustration shown in FIGS. 2 and 3, the form panels 4 and 5 are orientated on the outside and inside of the wall respectively, and a form liner 25 is provided, and includes a first surface 26 thereof abutting and being laterally supported by an interior surface 27 of the inside panel 5. The liner 25 includes a contoured second side 28 positioned in spaced relation to the interior surface 29 of the outside panel 4, and includes a marginal edge portion 30 and a medial portion 31 projecting outwardly therefrom to form contiguous post and beam portions of the form 33 and 34 respectively. The rod 14 is positioned on the tie bars 3 in a manner whereby the wire mesh 15 is adjacent the same on the outside surface of the rod, and holds the wire mesh 15 in a plane which is equidistant from the outside surface of the liner medial portion 31 and the inside surface of the outside form panel 4. In the illustrated example, the distance between the outside surface of the liner medial portion 31 and the inside surface of form panel 4 is reduced to in the nature of 3 inches, thereby requiring accurate mesh positioning. The second rod 16 is positioned in a spaced apart manner relative to the first rod 14, as illustrated, in the nature of 3⅞ inches, and is positioned near the geometric center of the post portion 33 of the wall cavity.

In use, the inside form panels 5 are, as illustrated in FIG. 3, positioned in a side-by-side manner on a base support, such as a footing, slab, or the like (not shown). The ties 1 are then placed between adjacent inside panels and are connected therewith by means such as the illustrated retaining pin mechanisms 9. The form liners 25 are then located between the tie bars 3 with the interior surface 26 of the liner abutting the interior surface 27 of the inside panel 5. Flat sections of reinforcing wire mesh 15 are then positioned over each of the tie bars, threading the same through the wire mesh apertures, and the mesh is located adjacent to and abutting the rod 14. The wire mesh is preferably provided from flat panels thereof as opposed to paying the same from a roll, so as to avoid a wavy condition or non-flat set in the mesh. In the illustrated example, wire ties 38 are provided to attach the wire mesh 15 to the rod 14. The opposing end of each tie bar 3 is then connected with the outside form panel 4. The rods 14 and 16 rigidly interconnect each of the tie bars 3 in a preset, aligned, and plumb orientation. When the form panels are being used to construct a vertical wall, the tie bars are held by the rods 14 and 16 in a substantially horizontal position and prevent the tie bars from twisting with respect to the rods into a parallelogram shape with the form panels. Hence, the form arrangement is not only strong enough to support the weight of the concrete poured therein, but is also sufficiently sturdy to resist movement from the present position as a result of inadvertent blows, such as might be caused by collision with construction equipment, tools and the like. Equipment such as braces, material handling devices, scaffolding, and the like may be attached to and supported by the wall forms before they are filled with concrete, without causing the wall forms to tip or be pulled out of alignment.

The rod 14 accurately and securely positions the wire mesh 15 centrally between the inner surface of the outside form panel, and the medial portion 31 of the form liner for increased wall strength and reduced material usage. The arrangement also securely and accurately positions the tie rod 16 near the geometric center of the post portion of the wall cavity for increased strength. The U-shaped bracket 20 is automatically and contemporaneously located a predetermined distance above the uppermost tie bar 3, whereby the horizontally disposed reinforcing rod 21 is positioned adjacent the beam portion 34 of the wall cavity.

Figure 4:
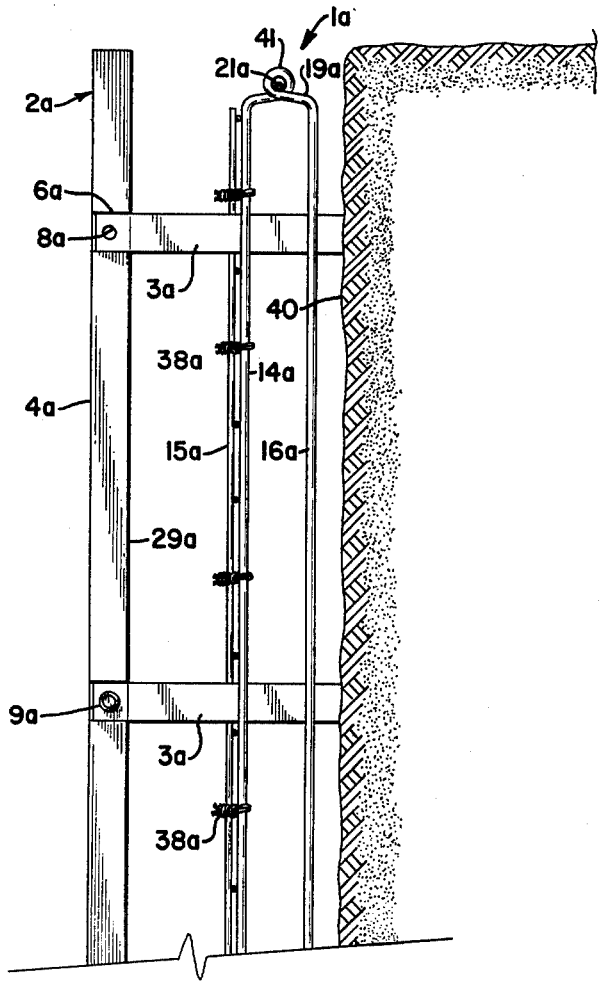
FIG. 4 is a fragmentary side elevational view of another embodiment of the present invention.

The reference numeral **2*a* generally designates another embodiment of the present invention which, as illustrated in FIG. 4, includes a tie 1*a* adapted for use in conjunction with a single wall of form panels 4*a*, and an excavated, retaining surface 40. Since the form arrangement 2*a* is otherwise quite similar to the previously described structure 2, similar parts appearing in FIGS. 1–3 and 4 respectively are represented by the same, corresponding reference numeral, except for the suffix "a" in the numerals of the latter, unless specifically noted otherwise. The form arrangement 2*a* includes at least two prefabricated form panels 4*a* which are interconnected in a side-by-side manner. A concrete forming surface, such as the illustrated excavated, earthen surface 40 is spaced apart from the form panels 4*a*, opposes the same, and defines a wall cavity thereinbetween. The form tie 1*a* comprises at least two bars 3*a* disposed in a mutually spaced apart relation. The tie bars 3*a* extend laterally from the form panels 4*a* and are fixedly interconnected by vertically disposed rods 14*a* and 16*a*. The reinforcing wire mesh 15*a* is attached to one of the vertical rods 14*a* and 16*a*, and in the illustrated structure is attached to the outwardly positioned surface of the rod 14*a*. In the structure illustrated in FIG. 4, the upper ends of the rods 14*a* and 16*a* are formed into a loop 41 which is integral and adapted for receiving a horizontally disposed reinforcing rod 21*a* therein. The end edges of the form panels 4***a* are notched to receive the tie bars 3*a* therein, and prevent the same when interconnected with an adjacent form panel from rotating about the fastener pin 9*a*. Hence, the tie 1*a* in combination with the form panels 4*a* forms a rigid rectangular structure which is self-supporting and securely positions the wire mesh 15*a* between the form panels 4*a* and the excavated surface 40. The structure may be supported by external side brace, and/or a footing (not shown), or similar support for retaining the lower ends of the tie 1*a*.

It is to be understood that while I have illustrated and described certain forms of my invention, it is not to be limited to the specific forms or arrangement of parts herein described and shown.

What I claim and desire to secure by Letters Patent is:

1. In a form for poured concrete walls having a plurality of prefabricated, interconnected form panels, and wherein first and second of said panels are positioned on opposed sides of a wall cavity in a spaced apart and laterally aligned relation, the improvement of a form tie comprising:

(a) at least two, flat, rectangularly shaped tie bars disposed in a mutually spaced apart relation; each of said tie bars extending laterally between said first and second form panels, and having an aperture through each end thereof for connecting the same with said first and second form panels respectively; and (b) first and second elongate rods, each positioned substantially perpendicularly to each of said tie bars and being fixedly attached thereto; said first and second rods being mutually parallel and spaced apart, and securely retaining said tie bars in alignment; said first rod being shaped for connecting reinforcing mesh thereto and positively positioning said mesh along a predetermined plane between said first and second form panels; and wherein (c) said first and second rods each have an upper end thereof which is bent into an L-shape; said upper end of each of said rods facing inwardly and overlapping in a side-by-side fashion, and being fixedly interconnected to form a U-shaped bracket which is normally upwardly oriented and shaped to cradle and retain a horizontally disposed reinforcing member therein.

2. A form as set forth in claim 1 including:

(a) a form liner positioned between said first and second form panels having a first side thereof abutting and being laterally supported by an interior surface of one of said form panels; said liner having a second side thereof in spaced relation to the other form panel and including a marginal edge portion and a medial portion projecting outwardly therefrom forming contiguous post and beam portions of said form; and wherein (b) said second elongate rod is positioned geometrically centrally in the post portion of said form.

3. A form as set forth in claim 2 including:

(a) wire mesh positioned over each of said tie bars and arranged adjacent to said first rod; and (b) means fastening said wire mesh to said first rod, whereby said wire mesh is retained centrally between said form liner medial portion and the other of said form panels in a substantially planar and parallel relationship therewith.

4. A form as set forth in claim 3 including a horizontally disposed reinforcing rod positioned in and supported by said U-shaped bracket; said horizontally disposed reinforcing rod extending longitudinally and being positioned in the beam portion of said form.

* * * * *